US005586755A

United States Patent [19]

Hansen

[11] Patent Number: 5,586,755

[45] **Date of Patent: *Dec. 24, 1996**

[54] MISFEED DETECTOR FOR A STACK OF DIFFERENT WEIGHT SHEETS

[75] Inventor: Paul Hansen, Westminster, Calif.

[73] Assignee: Xerox Corporation, Stamford, Conn.

[ * ] Notice: The term of this patent shall not extend beyond the expiration date of Pat. No. 5,503,382.

[21] Appl. No.: 387,678

[22] Filed: Feb. 13, 1995

[51] Int. Cl.[6] ..... B65H 7/00

[52] U.S. Cl. ..... 271/9.06; 271/3.03; 271/3.06; 271/258.01; 271/259; 271/262

[58] Field of Search ..... 271/3.03, 3.05, 271/3.06, 9.05, 9.06, 258.01, 259, 262, 263, 265.04

[56] References Cited

U.S. PATENT DOCUMENTS

| | | | |
|---|---|---|---|
| 4,462,587 | 7/1984 | Graef et al. | 271/263 |
| 4,536,078 | 8/1985 | Ziehm | 271/3.03 |
| 4,651,982 | 3/1987 | Martin | 271/263 |
| 4,825,248 | 4/1989 | Honjo et al. | 271/259 |
| 4,881,104 | 11/1989 | Kusumoto et al. | 271/9.05 |
| 5,067,704 | 11/1991 | Tsuihiji et al. | 271/262 |
| 5,110,114 | 5/1992 | Yamaychi et al. | 271/263 |
| 5,114,138 | 5/1992 | Ichinose | 271/263 |
| 5,135,114 | 8/1992 | Satake et al. | 209/588 |
| 5,276,628 | 1/1994 | Schneiderhan | 271/259 |

FOREIGN PATENT DOCUMENTS

| | | | |
|---|---|---|---|
| 0195105 | 9/1986 | Eritrea | 271/262 |
| 161242 | 12/1981 | Japan | 271/263 |
| 3116441 | 5/1987 | Japan | 271/263 |
| 0117542 | 5/1990 | Japan | 271/262 |
| 0144353 | 6/1990 | Japan | 271/262 |
| 204251 | 8/1990 | Japan | 271/262 |
| 3-3844 | 1/1991 | Japan | 271/262 |
| 72593 | 3/1994 | Japan | 271/262 |

*Primary Examiner*—David A. Bucci
*Assistant Examiner*—Douglas Hess
*Attorney, Agent, or Firm*—Sheldon Raizes

[57] ABSTRACT

The invention relates to an apparatus for detecting sheet misfeed from a tray having at least two sheets whose thickness differs from each other. The thickness of each sheet is detected as it enters into the tray and that value is placed in memory. The thickness of each sheet is detected as it leaves the tray and that value of each sheet is compared to the thickness value in memory for the same sheet when it entered into the tray. If the values match, then only one sheet has been fed from the tray. If the thickness value of the sheet as it leaves the tray is more that the thickness value in memory, then that indicates that more than one sheet has left the tray and a signal is produced which results in the sheet feed system being shut down to enable an operator to correct the situation.

20 Claims, 2 Drawing Sheets

MISFEED DETECTOR FOR A STACK OF DIFFERENT WEIGHT SHEETS

This application is related to U.S. application Ser. No. 08/387,672, now U.S. Pat. No. 5,503,382, entitled Misfeed Detector For Multi-Tray And Intermediate Tray Sheet Feeders, filed Feb. 13, 1995, and to U.S. application Ser. No. 08/387,673, entitled Misfeed Detector For Multi-Tray Sheet Feeders, filed Feb. 13, 1995. Each of these applications is assigned to the assignee of this application.

BACKGROUND

This invention relates to a system for detecting a double sheet feed from a stack of different weight sheets.

It is common to employ a multi tray sheet feeder with laser printers. The sheets are fed from the multi tray sheet feeder to an intermediate or buffer sheet stacker or tray and then fed into the printer from the intermediate or buffer sheet tray. It is important that only one sheet at a time be fed from the intermediate tray and if more than one sheet is fed from the intermediate tray, that it be detected immediately and the system be shut down to correct the situation or the offending sheets can be sent to a purge tray at the printer without shutting down the system. The sheets in one tray of the multi tray sheet feeder may be of a thickness which is different than the thickness of the sheets in another tray of the multi tray sheet feeder and therefore, the intermediate tray can contain sheets of different thicknesses. Therefore, there must be a way of detecting a double sheet feed while still acknowledging that sheets of different thicknesses are in the intermediate sheet tray.

SUMMARY OF INVENTION

In accordance with this invention, the thickness of each sheet is detected as it enters into the intermediate sheet stacker and that value is placed in memory. The thickness of that sheet is detected as it leaves the intermediate sheet tray and that value is compared to the thickness value in memory when it entered into the intermediate sheet tray. If the values match, then only one sheet has been fed from the intermediate sheet tray. If the thickness value of the sheet as it leaves the intermediate sheet tray is more than the thickness value in memory, then that indicates that more than one sheet has just left the intermediate sheet tray and the system is shut down to enable an operator to correct the situation.

DETAILED DESCRIPTION OF PREFERRED EMBODIMENT

Figure 1:
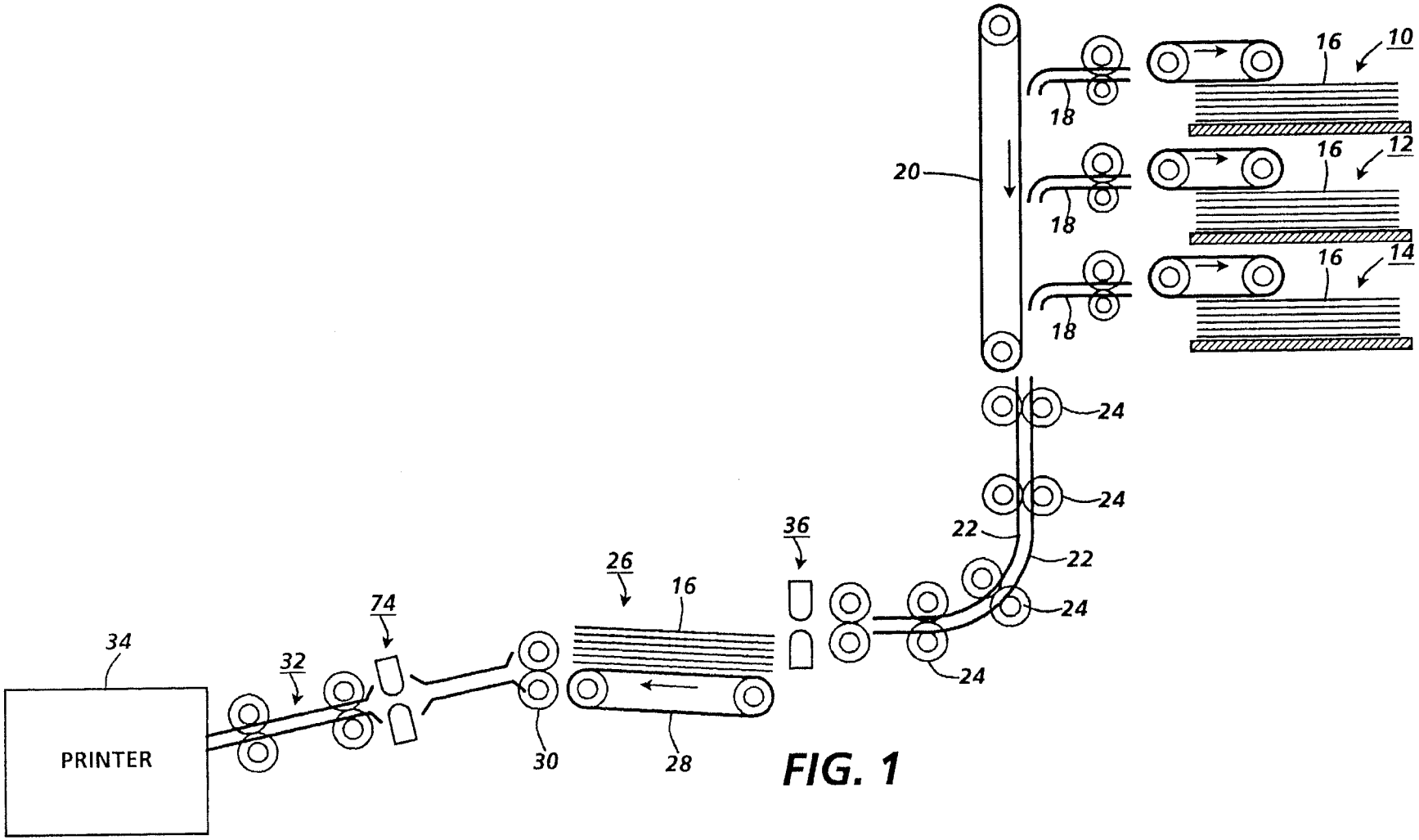
FIG. 1 is a schematic view of a printing system which includes a multi sheet feed detector of this invention.

Referring to FIG. 1, there is shown a printing system comprising three feed trays 10, 12, and 14, each having a plurality of sheets 16 stacked therein. The sheets in each tray are of the same thickness as the others in the same tray, but are of a different thickness than the sheets in the other trays. A sheet feeding apparatus 18 is provided for each feed tray and a common vacuum sheet transport belt conveyor 20 transports a sheet to guides 22 where a plurality of driven nip rolls 24 move a sheet through the guides to an intermediate stacker 26. Sheets are bottom fed from the stacker 26 by a vacuum transport belt 28 to nip rolls 30 which move the sheets to a printer entry transport 32 from which the sheets enter a laser printer 34 where an image is transferred to each sheet.

Figure 2:
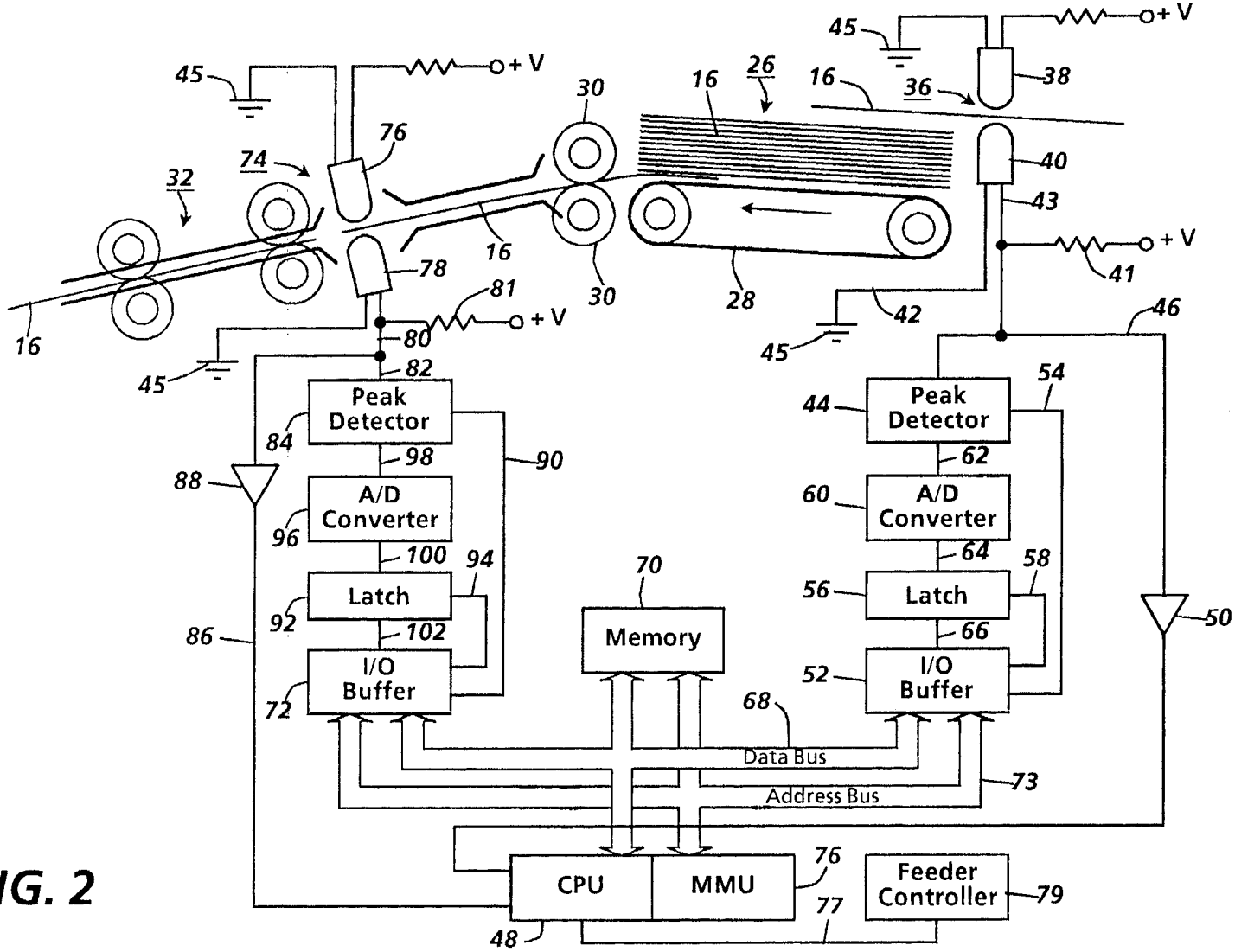
FIG. 2 is a block diagram of the multi sheet feed detector operating system.

Referring to FIG. 2, there is shown the intermediate sheet stacker 26 and a sheet thickness sensing arrangement. An inlet sensor 36 is provided at the inlet of the stacker 26 and comprises an infrared emitter 38 and a phototransistor 40. The collector 43 of the phototransistor 40 is connected through a control line 42 to a peak detector 44 and through control line 46 to a CPU (central processing unit) 48. A positive transition detector 50 is located in control line 46 between the phototransistor 40 and the CPU 48 and detects sudden voltage changes at the collector 43. The peak detector 44 detects a peak voltage at collector 43 and is connected to an I/O (Input/output) buffer 52 through a control line 54 to allow the CPU to reset the peak detector to zero. A latch 56 is connected to the I/O buffer 52 through a control line 58 to allow the CPU to implement a data latch function. An A/D (analog/digital) converter 60 is connected to the peak detector 44 by line 62 and to the latch 56 by a 10 bit data line 64. A 10 bit data line 66 connects the latch 56 to the I/O buffer 52. A 16 bit data bus 68 links the CPU 48 with the I/O buffer 52, memory 70 and another I/O buffer 72. An address bus 73 links a MMU (memory management unit) 76 with the I/O buffers 52 and 72 and the memory 70.

The memory 70 is a two part memory having a RAM and an EPROM. The EPROM contains a program for controlling measurement and storage of thickness values of the sheets 16 arriving at the inlet sensor 36 from the trays 10, 12, and 14 and arriving at an outlet sensor 74 from the intermediate stacker 26 and for comparison of the thickness values for detecting double sheet feed from the intermediate stacker 26. The CPU 48 is connected through a control line 77 to a feeder controller 79 for controlling feeding of the sheets from the trays 10, 12, and 16 and into and out of the intermediate stacker 26.

At the outlet of the intermediate stacker 26 is the outlet sensor 74 which comprises an infrared emitter 76 and a phototransistor 78 with a collector 80. The collector 80 of the phototransistor 78 is connected through a control line 82 to a peak detector 84 and through control line 86 to the CPU 48. A positive transition detector 88 is located in control line 86 between the phototransistor 78 and the CPU 48 and detects sudden voltage changes at the collector 80. The peak detector 84 detects a peak voltage at collector 80 and is connected to the I/O buffer 72 through a control line 90 to allow the CPU to reset the peak detector to zero. A latch 92 is connected to the I/O buffer 72 through a control line 94 to allow the CPU to implement a data latch function. An A/D converter 96 is connected to the peak detector 84 by line 98 and to the latch 92 by a 10 bit data line 100. A 10 bit data line 102 connects the latch 92 to the I/O buffer 72.

The amount of current that flows through the phototransistors 40, 78 is a function of the amount of light to which a phototransistor is exposed. If the exposure to light is increased, more current will flow and if the exposure to light is decreased, less current will flow. The emitters 38 and 76 each emits rays towards the base of its respective phototransistor 40 and 78 and strikes the phototransistors 40, 78 at maximum intensity when a sheet of paper is not between the emitter and its respective phototransistor. Therefore, there is maximum current flow across a resistor 41 when a sheet of paper is not between emitter 38 and its respective phototransistor 40 and the voltage difference between ground and the collector 43 of the phototransistor 40 is at its lowest value in this condition. It also follows that there is maximum current flow across a resistor 81 when a sheet of paper is not between emitter 76 and its respective phototransistor 98 and the voltage difference between ground and the collector 80 of the phototransistor 78 is at its lowest value in this condition.

When a sheet of paper passes between the emitter 38 and the phototransistor 40, light from the emitter will pass through the sheet of paper with the amount of light passing through being dependent upon the thickness of the paper. More light will pass through a thin sheet than a thick sheet. Since the phototransistor 40 is exposed to less light when a sheet of paper is passing between the emitter 38 and the phototransistor 40, less current flows across resistor 41 and the voltage difference between the collector 43 and ground 45 increases. The voltage difference between ground 45 and the collector 41 will increase in accordance with an increase in the thickness of a sheet since the amount of light to which the phototransistor 40 is exposed decreases as the thickness of a sheet sensed increases. This principle also applies when a sheet of paper passes between the emitter 76 and the phototransistor 98 and therefore the voltage difference between ground 45 and the collecter 80 will increase in accordance with an increase in the thickness of a sheet.

In operation, when a sheet 16 is introduced into the sensor 36, there will be a sudden voltage change at the collector 43 which is sensed by the positive transition detector 50 which causes an interrupt through the control line 46 at CPU 48. The CPU will be programmed to only respond to the initial interrupt and ignore any subsequent interrupts until after the sheet of paper 16 has left the sensor 36. In response to the initial interrupt, the CPU, in conjunction with the MMU 76, addresses the I/O buffer 52 which immediately resets the peak detector 44. The voltage at collector 43 can be sampled only once per sheet or a plurality of times as the sheet passes through the sensor. Sampling the sheet thickness once has a drawback if the sheet has a hole in it, has an opaque portion or, if it is a preprinted form, has light and dark printing on it, since, if any of these are sensed, an incorrect reading of the thickness of a sheet will occur. Therefore it is desirable to sample the thickness of the sheet at more than one location. For example, the sheet can be sampled six times as the sheet passes through the sensor 36. Assuming that the sheet is 8½×11 inches and the 11 inch edge is the leading edge into the sensor 36, and the sheet passes across the sensor 36 at a speed of 65 inches per second, each sheet section sensed before sampling will be 1.4 inches and sampling will occur every 22 milliseconds.

The peak detector senses the voltage at collector 43 as the sheet passes between the emitter 38 and the phototransistor 40 with this voltage representing the thickness of the sheet. The voltage at the peak detector 44 is inputted to the A/D converter 60 in analog form and this is converted to digital form by the A/D converter 60 and sent to the latch 56. The first sensing will be completed by a first sampling taken 22 milliseconds after entry of the sheet into the sensor 36. The latch will be set at 22 milliseconds to capture the peak voltage in peak detector 44 and the peak detector reset immediately thereafter for detecting the voltage over the next 1.4 inches of the sheet. Some time between the expiration of the first 22 milliseconds and the expiration of the next 22 milliseconds, the I/O buffer 52 will send the voltage information for the first sampling of the sheet to the memory 70. The same cycle is repeated until after the sixth 1.4 inch section is sampled. When a new sheet is introduced into the sensor 36, the sudden voltage change at the collector 43 is sensed by the positive transition detector 50 which causes an interrupt at the CPU 48 and the same cycle is repeated for the new sheet.

When a sheet 16 is introduced into the intermediate outlet sensor 74, there will be a sudden voltage change at the collector 80 which is sensed by the positive transition detector 88 which causes an interrupt through the control line 86 at the CPU 48. The CPU is programmed to only respond to the initial interrupt and ignore any subsequent interrupts until after the sheet of paper has left the sensor 74. In response to the initial interrupt, the CPU, in conjunction with the MMU 76, addresses the I/O buffer 72 which immediately resets the peak detector 84. The voltage at collector 80 is sampled the same number of times as the voltage at collector 43 is sampled. The sheet passes across the outlet sensor 74 at approximately ½ the speed that the sheet passes through the inlet sensor 36. Therefore, each sheet section sensed before sampling will be 1.4 inches and sampling will occur every 44 milliseconds.

The peak detector 84 senses the voltage at collector 80 as the sheet passes between the emitter 76 and the phototransistor 78 with this voltage representing the thickness of the sheet. The voltage at the peak detector 84 is inputted to the AID converter 96 in analog form and this is converted to digital form by the AID converter 96 and sent to the latch 92. The first sensing will be completed by a first sampling taken 44 milliseconds after entry of the sheet into the sensor 74. The latch will be set at 44 milliseconds to capture the peak voltage in peak detector 84 and the peak detector is reset immediately thereafter for detecting the voltage over the next 1.4 inches of the sheet. Some time between the expiration of the first 44 milliseconds and the expiration of the next 44 milliseconds, the I/O buffer 72 will send the voltage information for the first sampling of the sheet to the memory 70. The same cycle is repeated until after the sixth 1.4 inch section is sampled. When a new sheet is introduced into the sensor 74, the sudden voltage change at the collector 80 is sensed by the positive transition detector 88 which causes an interrupt at the CPU 48 and the same cycle is repeated for the new sheet.

After the sixth 1.4 inch section of a sheet 16 is sampled while the sheet passes through outlet sensor 74, the six sampled values of the sheet as it passed through the inlet sensor 36 are compared with the six sampled values of the sheet as it passed through the intermediate stacker outlet sensor 74. This can be achieved by comparing the sum of the six sensed values sensed at the inlet sensor with the sum of the six sensed values at the outlet sensor. If the sums are within a chosen tolerance of each other, it will be assumed that only one sheet has passed through the intermediate outlet sensor 74 and normal operation of the printing system will continue. If the sum of the six sensed values at the outlet sensor 74 is lower than the sum of the six sensed values at the inlet sensor 36 by more than a chosen tolerance, then such will indicate a greater sheet thickness at the outlet sensor than at the inlet sensor for the same sheet. Thus, it will be assumed that more than one sheet has passed through the intermediate outlet sensor 74 and a signal will be sent by the CPU 48 over the control line 77 to the feeder controller 79 to immediately stop the sheet feeding system. A system operator can then remove the double fed sheets and any other sheets that are affected and reset the system to resume normal operation. Alternatively, in response to the signal, the offending sheets can be sent to a purge tray at the printer without stopping the sheet feeding system The comparison function can be conducted as a new sheet is fed into the outlet sensor 74. This way, the system is not held up while a comparison is being made. Also, instead of comparing sums of values, each value sampled at the inlet sensor 34 can be compared with each corresponding value sampled at the outlet sensor 74. If a certain number of values match within a given tolerance, it will be assumed that only one sheet passed throught the outlet sensor 74. For instance, if four of the six sensed values match, it will be assumed that only one sheet passed through the outlet sensor 74. Obviously, other ways of comparing values can be used and the number of samplings can be changed to a particular situation desired.

In order to know which sheet is entering the intermediate stacker outlet sensor 74, a first in, first out system is set up. If a plurality of sheets are introduced into the intermediate stacker after passing through the inlet sensor 36, the first sheet into the stacker will be the first sheet out of the stacker since the vacuum transport belt 28 is at the bottom of the stacker and feeds sheets to the outlet sensor 74 from the bottom of the stack of sheets 26.

The detect system can also be used to detect a sheet which is being fed out of turn as well as double fed sheets. This is accomplished by having the CPU 48 send a signal at any time the values compared differ from one another above a chosen tolerance instead of only sending a signal when the value at the outlet sensor 74 is lower than a tolerance value at the inlet sensor 36. Thus the system will catch a sheet that is not as thick as the sheet that is scheduled to exit the intermediate stacker. This can happen if a double sheet feed is missed.

From the above, it can be seen that the system described will be able to ascertain a misfeed of sheets of variable weights that are located in a stacker.

The system and the electronic components thereof have been described in general. It should be realized that well known programming techniques and off-the-shelf hardware are all that is required to achieve the principles of this invention. Thus someone with ordinary skill in the art will be able to construct the system described.

I claim:

1. In a sheet transport system comprising:

a. a support tray for supporting a stack of sheets, b. an inlet operably connected to said support tray through which each sheet passes prior to entering into the stack of sheets on said tray, c. an outlet operably connected to said support tray through which each sheet passes upon being discharged from the stack of sheets on said tray, d. an inlet sensor at said inlet for sensing the thickness of a sheet passing through said inlet, e. an outlet sensor at said outlet for sensing the thickness of a sheet passing through said outlet, and f. means for comparing the thickness value sensed at the inlet sensor with the thickness value sensed at the outlet sensor of the same sheet and generating a signal indicating a misfeed if the values differ by a predetermined amount.

2. In a sheet transport system recited in claim 1 further comprising means for feeding sheets to said support tray and for feeding sheets from said support tray to said outlet, and means responsive to said signal for making inoperative said means for feeding sheets to said support tray and for feeding sheets from said support tray to said outlet.

3. In a sheet transport system recited in claim 1 wherein said inlet sensor and said outlet sensor each comprises an infrared emitter located on one side of a sheet passing through a respective sensor and a phototransistor located on the opposite side of a sheet passing through a respective sensor and arranged to receive rays emitted by said infrared emitter.

4. In a sheet transport system recited in claim 3, wherein each said phototransistor has a collector referenced to ground and the sheet thickness value is sensed by said sensors by detecting a potential between ground and said collector as a sheet passes between said infrared emitter and said phototransistor.

5. In a sheet transport system comprising:

a. a support tray for supporting a stack of sheets, b. an inlet operably connected to said support tray through which each sheet passes prior to entering into the stack of sheets on said tray, c. an outlet operably connected to said support tray through which each sheet passes upon being fed from the stack of sheets on said tray, d. an inlet sensor at said inlet for sensing the thickness of a sheet passing through said inlet and storing the thickness value sensed, e. an outlet sensor at said outlet for sensing the thickness value of a sheet passing through said outlet, f. means for keeping track of a sheet after it passes through said inlet sensor until it passes through said outlet sensor; and g. means for comparing the thickness value sensed at the outlet sensor with the stored thickness value sensed at the inlet sensor of the same sheet and generating a signal indicating a misfeed if the values differ by a predetermined amount.

6. In a sheet transport system recited in claim 5 further comprising means for feeding sheets to said support tray and for feeding sheets from said support tray to said outlet, and means responsive to said signal for making inoperative said means for feeding sheets to said support tray and for feeding sheets from said support tray to said outlet.

7. In a sheet transport system recited in claim 5 wherein the value of the thickness of a sheet sensed at the outlet sensor is stored and said means for comparing compares the stored thickness value sensed at the inlet sensor with the stored thickness value sensed at the outlet sensor of the same sheet.

8. In a sheet transport system recited in claim 7 further comprising means for feeding sheets to said support tray and for discharging sheets from said support tray to said outlet, and means responsive to said signal for making inoperative said means for feeding sheets to said support tray and for feeding sheets from said support tray to said outlet.

9. In a sheet transport system recited in claim 5 wherein said inlet sensor and said outlet sensor each comprises an infrared emitter located on one side of a sheet passing through a respective sensor and a phototransistor located on the opposite side of a sheet passing through a respective sensor and arranged to receive rays emitted by said infrared emitter.

10. In a sheet transport system recited in claim 9, wherein each said phototransistor has a collector referenced to ground and the sheet thickness value is sensed by said sensors by detecting a potential between ground and said collector as a sheet passes between said infrared emitter and said phototransistor.

11. In a sheet transport system comprising:

a. at least two trays of sheets stacked thereon with the sheets on one tray being of a different thickness than the sheets on the other tray, b. an intermediate tray for receiving sheets from said at least two trays, c. an inlet operably connected to said intermediate tray through which each sheet of said at least two trays passes prior to entering onto a stack of sheets on said intermediate tray, d. an outlet operably connected to said intermediate tray through which each sheet passes upon being discharged from the stack of sheets on said intermediate tray, e. means for selectively feeding sheets from each of said at least two trays to said intermediate tray, f. an inlet sensor at said inlet for sensing the thickness of a sheet passing through said inlet, g. an outlet sensor at said outlet for sensing the thickness of a sheet passing through said outlet, and h. means for comparing the thickness value sensed at the inlet sensor with the thickness value sensed at the outlet sensor of the same sheet and generating a signal indicating a misfeed if the values differ by a predetermined amount.

12. In a sheet transport system recited in claim 11 further comprising means responsive to said signal for making inoperative said means for selectively feeding sheets from each of said at least two trays to said intermediate tray.

13. In a sheet transport system recited in claim 11 wherein said inlet sensor and said outlet sensor each comprises an infrared emitter located on one side of a sheet passing through a respective sensor and a phototransistor located on the opposite side of a sheet passing through a respective sensor and arranged to receive rays emitted by said infrared emitter.

14. In a sheet transport system recited in claim 13, wherein each said phototransistor has a collector referenced to ground and the sheet thickness value is sensed by said sensors by detecting a potential between ground and said collector as a sheet passes between said infrared emitter and said phototransistor.

15. In a sheet transport system comprising:

a. at least two trays of sheets stacked thereon with the sheets on one tray being of a different thickness than the sheets on the other tray, b. an intermediate tray for receiving sheets from said at least two trays, c. an inlet operably connected to said intermediate tray through which each sheet of said at least two trays passes prior to entering onto a stack of sheets on said intermediate tray, d. an outlet operably connected to said intermediate tray through which each sheet passes upon being fed from the stack of sheets on said intermediate tray, e. means for selectively feeding sheets from each of said at least two trays to said intermediate tray, f. an inlet sensor at said inlet for sensing the thickness of a sheet passing through said inlet and storing the thickness value sensed, g. an outlet sensor at said outlet for sensing the thickness of a sheet passing through said outlet, h. means for keeping track of a sheet after it passes through said inlet sensor until it passes through said outlet sensor; and i. means for comparing the thickness value sensed at the outlet sensor with the stored thickness value sensed at the inlet sensor of the same sheet and generating a signal indicating a misfeed if the values differ by a predetermined amount.

16. In a sheet transport system recited in claim 15 further comprising means responsive to said signal for making inoperative said means for selectively feeding sheets from each of said at least two trays to said intermediate tray.

17. In a sheet transport system recited in claim 15 wherein the value of the thickness of a sheet sensed at the outlet sensor is stored and said means for comparing compares the stored thickness value sensed at the inlet sensor with the stored thickness value sensed at the outlet sensor of the same sheet.

18. In a sheet transport system recited in claim 17 further comprising means for feeding sheets to said support tray and for feeding sheets from said support tray to said outlet, and means responsive to said signal for making inoperative said means for feeding sheets to said support tray and for feeding sheets from said support tray to said outlet.

19. In a sheet transport system recited in claim 15 wherein said inlet sensor and said outlet sensor each comprises an infrared emitter located on one side of a sheet passing through a respective sensor and a phototransistor located on the opposite side of a sheet passing through a respective sensor and arranged to receive rays emitted by said infrared emitter.

20. In a sheet transport system recited in claim 19 wherein each said phototransistor has a collector referenced to ground and the sheet thickness value is sensed by said sensors by detecting a potential between ground and said collector as a sheet passes between said infrared emitter and said phototransistor.

* * * * *